US007159664B1

(12) United States Patent
Ross

(10) Patent No.: US 7,159,664 B1
(45) Date of Patent: Jan. 9, 2007

(54) METHOD OF PASSING INSULATED WIRES THROUGH A WELLHEAD OPENING

(75) Inventor: Bryan D. Ross, Molalla, OR (US)

(73) Assignee: Sanetel Pumps, Inc., Oregon City, OR (US)

( * ) Notice: Subject to any disclaimer, the term of this patent is extended or adjusted under 35 U.S.C. 154(b) by 288 days.

(21) Appl. No.: 10/946,880

(22) Filed: Sep. 22, 2004

(51) Int. Cl.
*E21B 19/00* (2006.01)
*H02G 3/08* (2006.01)

(52) U.S. Cl. ..... 166/379; 166/77.1; 166/75.13; 220/3.8; 138/89

(58) Field of Classification Search ..... 166/75.13, 166/65, 241, 379, 385, 77.1; 220/3.8; 138/89
See application file for complete search history.

(56) References Cited

U.S. PATENT DOCUMENTS 2,793,699 A * 5/1957 Tubbs ..... 166/75.13
3,035,732 A * 5/1962 Baker ..... 220/3.8
3,136,362 A * 6/1964 Baker ..... 166/85.2
3,563,310 A * 2/1971 Wellstein ..... 166/85.2
3,722,586 A * 3/1973 Baker ..... 166/85.2
4,023,699 A * 5/1977 Lien ..... 220/3.8
6,513,597 B1 2/2003 Uhlenkott ..... 166/369
6,575,664 B1 6/2003 Kassel et al. ..... 405/152
6,668,934 B1 12/2003 Uhlenkott ..... 166/369

* cited by examiner

*Primary Examiner*—David Bagnell
*Assistant Examiner*—David Andrews
(74) *Attorney, Agent, or Firm*—Law Office of Timothy E. Siegel; Timothy E. Siegel

(57) ABSTRACT

A method of extending an insulated wire through a wellhead opening of a well that includes casing having a top. The method makes use of an annular cap sized to engage and be retained by the top of the casing, the annular cap having smooth top and radially inward surfaces and defining an aperture. The annular cap is placed onto the top of the casing and the insulated wire is passed through the aperture, wherein should the insulated wire touch the annular cap the insulated wire will remain undamaged by the smooth top and radially inward surfaces.

8 Claims, 1 Drawing Sheet

METHOD OF PASSING INSULATED WIRES THROUGH A WELLHEAD OPENING

BACKGROUND OF THE INVENTION

A water well typically includes casing, i.e. metal tubing extending down at least the top portion of the well. This casing typically has a rough top surface that can cause some problems during pump installation and afterward. Specifically, pump installation entails lowering a pump into a well by a set of insulated wires that will power the pump after it is installed. If the wires are permitted to rub against the rough top of the casing, they may abrade away the insulation, leaving bare wire that can then short out against the conductive casing and the water, thereby creating an electric shock hazard. Accordingly, the job of the pump installer is made more difficult by the need to hold the insulated wires away from the casing as the pump and wires are lowered into the well.

Even after the pump has been installed, the wires may be left in such a manner that they will rub against the top of the casing. This, together with vibrations induced either by operation of the pump or by some nearby source can eventually cause the insulation to be abraded away, exposing the bare wires.

SUMMARY OF THE INVENTION

In a first separate aspect, the present invention is a method of extending an insulated wire through a wellhead opening of a well that includes casing having a top. The method makes use of an annular cap sized to engage and be retained by the top of the casing, the annular cap having smooth top and radially inward surfaces and defining an aperture. The annular cap is placed onto the top of the casing and the insulated wire is passed through the aperture, wherein should the insulated wire touch the annular cap the insulated wire will remain undamaged by the smooth top and radially inward surfaces.

In a second separate aspect, the present invention is a wellhead of a well that includes casing having a top and comprising an annular cap engaged to and retained by the top of the casing, the annular cap having smooth top and radially inward surfaces and defining an aperture. Also, an insulated wire extends through the aperture and is in physical contact to the smooth top and radially inward surfaces of the cap. The insulated wire is thereby protected from abrasion by the top of the casing.

The foregoing and other objectives, features and advantages of the invention will be more readily understood upon consideration of the following detailed description of the preferred embodiment(s), taken in conjunction with the accompanying drawings.

DETAILED DESCRIPTION OF THE PREFERRED EMBODIMENT(S)

Figures 1, 2, 3:
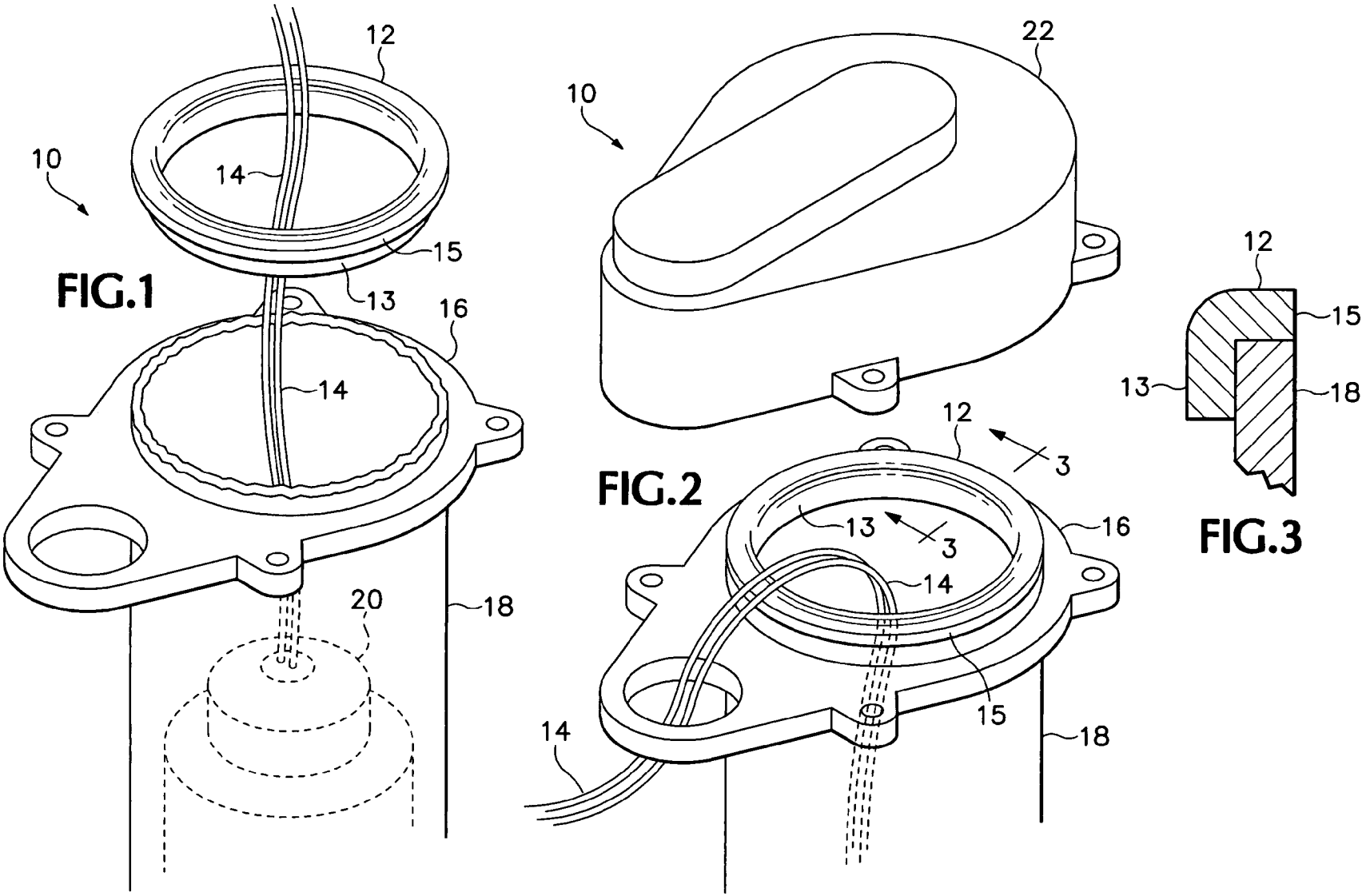
FIG. 1 is a perspective exploded view of a wellhead casing assembly according to the present invention.
FIG. 2 is a perspective view of the wellhead casing assembly of FIG. 1, with cap fitted in place and insulated wire extending through the wellhead casing aperture cover base.
FIG. 3 is a partial cross-sectional view of the cap fitted on the top edge of the wellhead casing, taken along line 3—3 of FIG. 2.

Referring to FIGS. 1 and 2, in a preferred method of extending insulated wire 14 through a wellhead casing 18, a lower inner rim 13 of an annular cap 12 having smooth radially inward surfaces is inserted into the top aperture of a wellhead casing 18, but kept from falling into wellhead casing 18 by a relatively large diameter top rim 15. The base of the wellhead cover 16 resides below the edge of the wellhead casing 18 and without the cap 12 would leave a rough edge exposed. With the cap 12 in place over the wellhead casing 18 aperture edge, insulated wires 14 are permitted to come in physical contact with the cap 12 during installation, removal, or use of the well pump 20 without risk of damage.

Referring to FIG. 2, a preferred embodiment of the wellhead casing assembly 10 has the cap 12 secured in place covering the edge of the wellhead casing 18. Insulated wires 14 extend over the cap 12 and out through the base of the wellhead casing cover 16. A protective cover 22 fastens to the base 16 enclosing the wellhead assembly 10.

Referring to FIG. 3, the blown-up, partial cross-sectional view of a preferred embodiment of the wellhead casing assembly 10 shows how the upper rim of the cap 12 extends over the top of the wellhead casing 18, covering the rough edge, and securing the cap 12 in place flush with the outer edge of the casing 18. Also shown is the smooth top and radially inward surface of the cap 12 meant to reduce friction and prevent damage to the insulated wire (not shown).

The advantages of this method of passing insulated wires 14 through a wellhead opening with a cap 12 installed on the top of the wellhead casing 18 should now be readily apparent. The smooth edges and radially inward surface of the cap 12 allow the insulated wires 14 to move freely within the wellhead casing 18 without damage during installation or removal of a well pump 20. Since the insulated wires 14 do not have to be kept in the center of the wellhead casing aperture, the preferred method of installation also requires less effort. This method is extremely unlikely to permit damage to the insulated wire 14, even under mechanical stress and vibration during pump 20 operation. Therefore, this method of insulated wire 14 installation is much more reliable and efficient than current methods.

In one preferred embodiment the inner diameter of the cap 12 is 14.5 cm (5.7 in). The height of the cap 12 is 2.8 cm (1.2 in) with a thickness of about 1.1 cm (0.4 in) at the thickest point. The outer diameter of the lower portion 13 of cap 12 is 15 cm (5.9 in), which is sized to fit flush in a standard six inch (15.24 cm) wellhead casing. The upper portion 15 of cap 12, having an outer diameter of about 17 cm (6.7 in), prevents cap 12 from sliding into wellhead casing 18. The cap 12 is most typically made out of molded polymeric material, but could be made out of steel or brass.

The terms and expressions that have been employed in the foregoing specification are used as terms of description and not of limitation. There is no intention, in the use of such terms and expressions, of excluding equivalents of the features shown and described or portions thereof, it being recognized that the scope of the invention is defined and limited only by the claims which follow.

The invention claimed is:

1. A method of extending an insulated wire through a wellhead opening of a well that includes casing having a top, comprising:

(a) providing an annular cap sized to engage and be retained by said top of said casing, said annular cap having smooth top and radially inward surfaces and defining an aperture;

(b) placing said annular cap onto said top of said casing; and (c) passing said insulated wire through said aperture, wherein should said insulated wire touch said annular cap said insulated wire will remain undamaged by said smooth top and radially inward surfaces.

2. The method of claim 1 wherein said insulated wire is grouped with at least one other insulated wire to form a plurality of insulated wires that are extended past said wellhead opening.

3. The method of claim 1 wherein said wire is attached to a pump that is being moved vertically inside said well.

4. The method of claim 3 wherein said pump is being lowered into said well as part of a pump installation.

5. The method of claim 4 wherein said annular cap is left in place on top of said casing after said pump installation is completed.

6. The method of claim 3 wherein said pump is being raised from said well in order to be serviced.

7. A wellhead of a well that includes casing having a top, comprising:

(a) an annular cap having a downwardly depending circular sidewall, fitting inside, engaged to and retained by said top of said casing, said annular cap having smooth top and radially inward surfaces and defining an aperture; and (b) insulated wire extending through said aperture and in physical contact to said smooth top and radially inward surfaces of said cap, said insulated wire thereby being protected from abrasion by said top of said casing.

8. The wellhead of claim 7 wherein said insulated wire is grouped with at least one other insulated wire to form a plurality of insulated wires that extend through said wellhead opening.

* * * * *